US005385610A

United States Patent [19]

Deerer et al.

[11] Patent Number: 5,385,610

[45] Date of Patent: Jan. 31, 1995

[54] SELF-ADJUSTING ROLL COATER

[75] Inventors: Richard P. Deerer, Grosse Pointe; Kenneth G. Huber, Grand Blanc, both of Mich.

[73] Assignee: Hoover Universal, Inc., Plymouth, Mich.

[21] Appl. No.: 132,753

[22] Filed: Oct. 6, 1993

[51] Int. Cl.[6] ..... B05C 1/02; B05C 1/08

[52] U.S. Cl. ..... 118/241; 118/258; 118/668; 118/681; 118/262; 118/249; 118/679

[58] Field of Search ..... 118/668, 681, 258, 262, 118/679, 241, 649, 249; 425/367; 100/168, 169, 170, 176; 156/361, 572

[56] References Cited

U.S. PATENT DOCUMENTS

| | | | |
|---|---|---|---|
| 571,527 | 11/1886 | Honiss et al. | 118/262 X |
| 1,973,316 | 9/1934 | Hormel | 118/262 X |
| 2,160,826 | 6/1939 | Boulton | 118/262 X |
| 2,185,859 | 1/1940 | Massey | 118/262 X |
| 2,237,641 | 4/1941 | Von Hofe | 118/241 X |
| 2,787,239 | 4/1957 | Shields | 118/680 X |
| 2,900,951 | 8/1959 | Kabelitz | 118/258 X |
| 3,719,167 | 3/1973 | Pahlitzsch | 118/261 X |
| 4,288,275 | 9/1981 | Davis | 118/68 X |
| 4,334,496 | 6/1982 | Juraschek | 118/249 X |
| 4,340,623 | 7/1982 | Justus | 118/115 X |
| 4,368,097 | 1/1983 | Clowe | 118/262 X |
| 4,472,235 | 9/1984 | Pasche | 118/262 X |
| 4,495,886 | 1/1985 | Phelps | 118/262 X |
| 4,495,890 | 1/1985 | Nikkel | 118/262 X |
| 4,601,256 | 7/1986 | Poterala | 118/248 X |
| 4,737,378 | 4/1988 | Narita | 118/249 X |
| 4,838,985 | 6/1989 | Karagiannis | 118/249 X |
| 4,852,515 | 8/1989 | Terasaka | 118/262 X |
| 4,893,485 | 1/1990 | Schwemmer | 118/60 X |
| 5,011,563 | 4/1991 | Shinno | 156/574 |
| 5,276,861 | 1/1994 | Shigeta | 118/262 X |

*Primary Examiner*—David A. Simmons
*Assistant Examiner*—Charles Rainwater
*Attorney, Agent, or Firm*—Harness, Dickey & Pierce

[57] ABSTRACT

A roll coating machine for applying liquid materials onto sheet material workpieces. The machine has particular application in the area of coating flexible foam sheets with stiffening or adhesive agents. The roll coater incorporates mechanisms for controlling the spacing between coating rollers which apply the liquid materials onto one or both sides of the workpiece and enables automatic adjustment for various thickness of material. Automatic adjustment is provided through accurate force balancing of one of the rollers and applying a highly controlled net force acting on the rollers such that the rollers self-adjust based on compression of the workpiece. Another mechanism provided in the machine of this invention incorporates pre-gauging and a cam adjustment mechanism for setting separation distance which can be used independently or in conjunction with a force balancing approach mentioned previously.

6 Claims, 5 Drawing Sheets

SELF-ADJUSTING ROLL COATER

BACKGROUND AND SUMMARY OF THE INVENTION

This invention relates to a material processing machine and particularly to a roll coater for applying liquids onto sheet material workpieces.

There are numerous instances in commercial material processing where liquids are coated onto sheet materials. For example, in the manufacture of headliners used in passenger motor vehicles such processes are frequently employed. Various techniques and designs of headliner manufacturing are presently known. In one process, an armature of soft flexible polyurethane foam is cut into thin sheets and coated with reactive components in a liquid state which polymerize to form a polyurethane which stiffens the substrate. Multiple layers of sheet materials may be coated and pressed together to provide adequate stiffness.

Various techniques for coating headliner substrates and other multi-layer assemblies are known. In one process, one liquid or two reactive components in liquid form are sprayed onto the sheet material workpiece as it passes along a conveyer through a processing station. Although spray coating operates effectively it is wasteful in that a substantial proportion of the material is lost as over-spray. The over-spray also may constitute an environmental hazard. Moreover, over-spray materials can interfere with the operation of other machinery and gives rise to increase maintenance costs.

Another process for coating substrates is known as roll coating. In this process, sheet material is fed between rolls which are coated with a liquid which transfers onto the workpiece. Although such machines generally operate satisfactorily they have a significant shortcoming; namely, they must be manually adjusted for a particular workpiece material thickness.

In conventional roll coaters, jack screw type separation adjustments are provided for the rollers. The separation between the rollers is especially important when soft open cell foam type materials are being coated. If the separation is excessively large, the coating rollers will not efficiently transfer the liquid onto the workpiece material. Conversely, if the separation is too small, the quantity of liquid retained by the workpiece is reduced since the rollers will "squeeze out" the transferred material. Accordingly, it is conventional practice to manually adjust the roller separation for a known sheet workpiece thickness. This requirement of manual adjustment makes the machines inflexible in terms of running parts of variable thickness. In certain production processes it would be desirable to provide a roll coater which can immediately and automatically respond to changes in workpiece thickness such that sheet material workpieces of varying thicknesses can be placed serially through the roll coater and each would receive an appropriate level of liquid retention.

Such desirable features of a roll coater are provided in this invention. The machine according to this invention features various mechanisms for providing an automatic adjustment characteristic. In one approach, one of the coating rollers is provided with an adjustment system including a moveable frame member which allows it to respond based on the pressure applied to it by the workpiece to adjust itself to an optimal roller separation. Despite the fact that the roll coater mechanisms are massive, the device according to this invention enables the rollers to respond to extremely minute forces exerted by the workpiece between the rollers, attributable in part to a precision counter-balancing of a moveable frame member which supports one of the rollers.

Another adjustment approach in accordance to this invention employs automatic pre-gauging in which a part is measured and a cam and follower device is actuated to set the separation between the coating rollers. In a hybrid arrangement, pre-gauging is used to set the coating roller separation within a range associated within a certain workpiece and the self-adjusting pressure actuated system described previously is employed to provide the final adjustment.

Irrespective of the approach used in accordance with this invention, parts of various thicknesses can be fed serially through the machine and a proper coating operation will be provided. This capability is especially advantageous where a wide range of material thickness are found in a finished item, for example in a headliner assembly in which a relatively thick soft polyurethane foam sheet is coated and thereafter reinforcing fiberglass mats or scrims and trim materials are coated to build up the various layers that define the headliner.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE INVENTION

Figures 1, 1A:
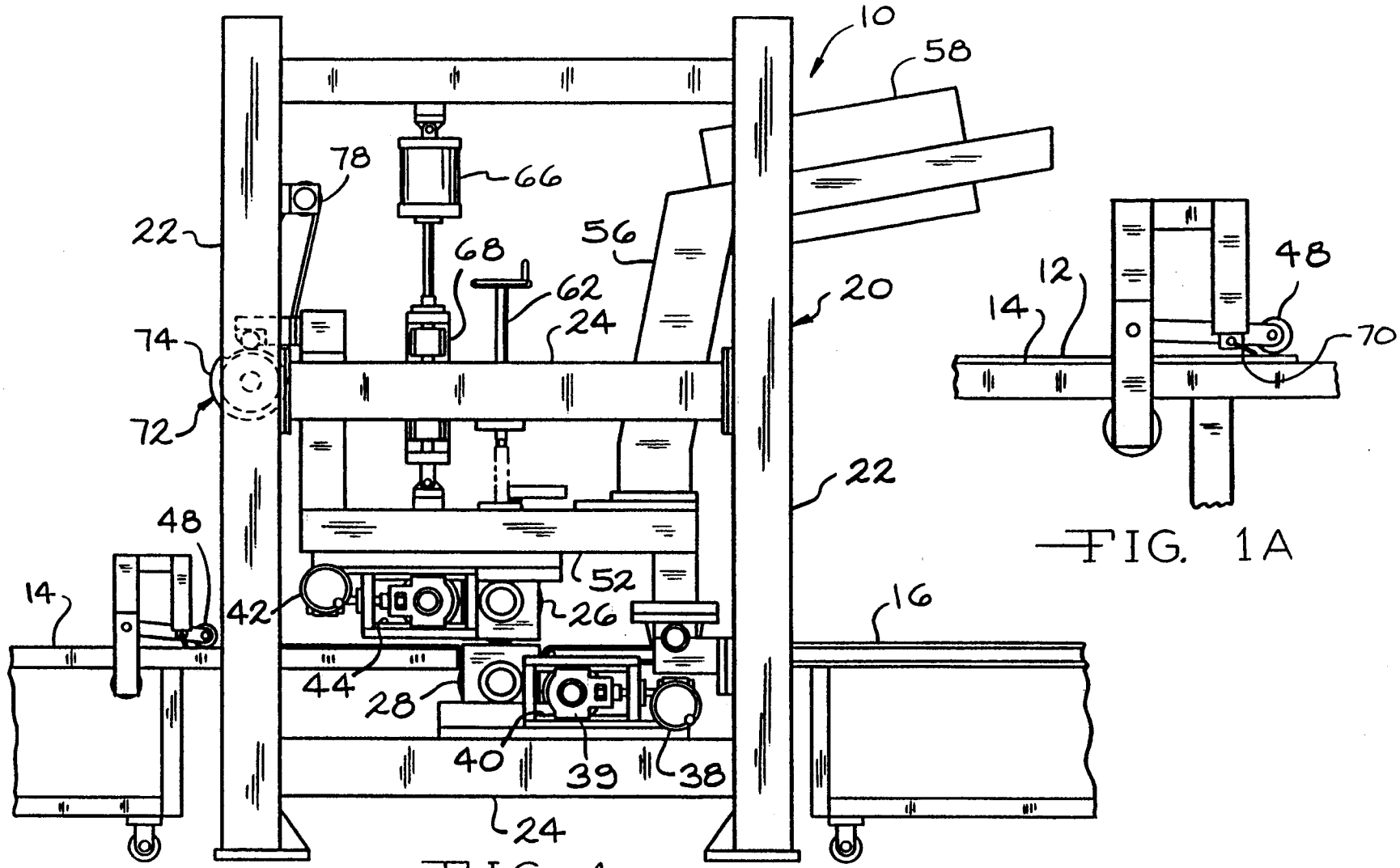
FIG. 1 is a side view of the roll coater machine according to this invention.
FIG. 1A is a partial side view of the roll coater of FIG. 1 particularly showing the thickness sensor gage component.

With reference to FIGS. 1 through 6, a roll coater machine in accordance with this invention is shown which is generally designated by reference number 10. Machine 10 is used for coating sheet material workpiece 12 which is fed into machine 10 through inlet conveyer 14 and removed through exit conveyer 16.

Figure 6:
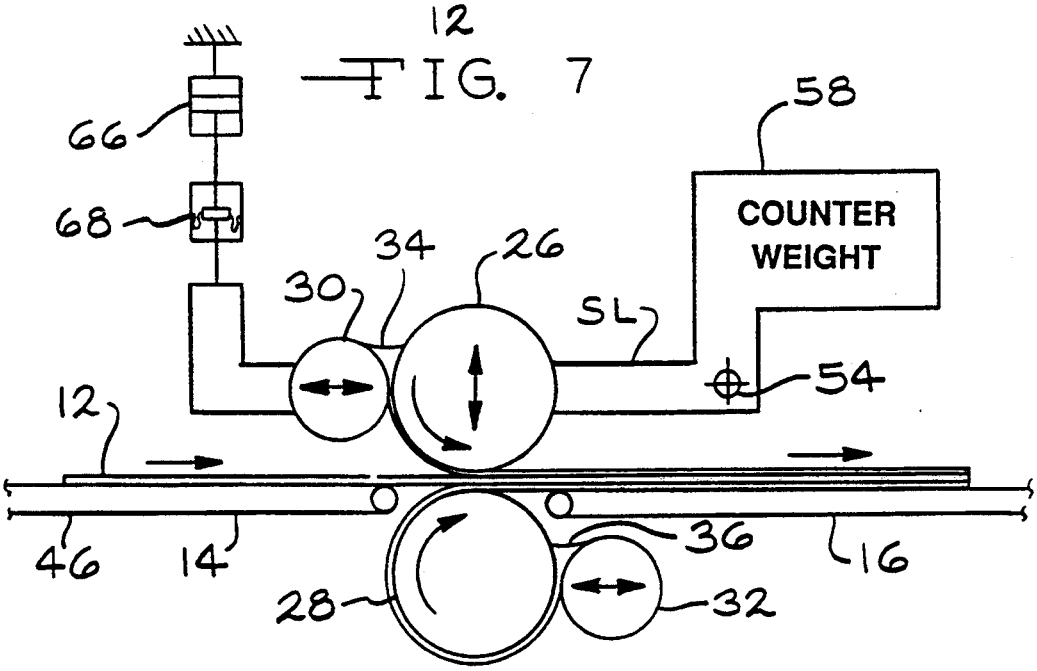
FIG. 6 is a simplified schematic view showing the coating operation of the machine of this invention.

Roll coater machine 10 has a large external frame 20 having vertical posts 22 and horizontal beams 24 which support the various elements comprising the machine. Machine 10 includes a pair of coating rollers 26 and 28, with upper roller 26 provided for coating the top surface of workpiece 12, whereas lower coating roller 28 is provided for coating the bottom surface of the workpiece. Rollers 26 and 28 are accurately machined cylinders which may be chrome plated. A pair of doctor rollers 30 and 32 are provided for coating rollers 26 and 28, respectively. Doctor rollers 30 and 32 are closely spaced against the associated coating rollers. As best shown in FIG. 6, a volume of a liquid material defining fluid baths 34 and 36 are retained between the associated rollers. End plates (not shown) are provided at the axial ends of the rollers to define the ends of the fluid baths. By maintaining a very close spacing between the coating rollers and associated doctor rollers the fluid baths 34 and 36 are retained.

As shown in FIG. 6 the coating rollers and doctor rollers rotate in opposite rotational directions. By accurately adjusting the separation between the coating rollers 26 and 28 and the associated doctor rollers 30 and 32, a fluid film of a desired thickness adheres to the coating roller which in turn contacts the workpiece to apply a film on the workpiece. In some instances it may be desirable to apply more liquid to one of the surfaces of the workpieces which can be accommodated by appropriate roller separation adjustments. A mechanism for maintaining the level of fluid in fluid baths 34 and 36 is provided which could be of conventional construction.

Figure 5:
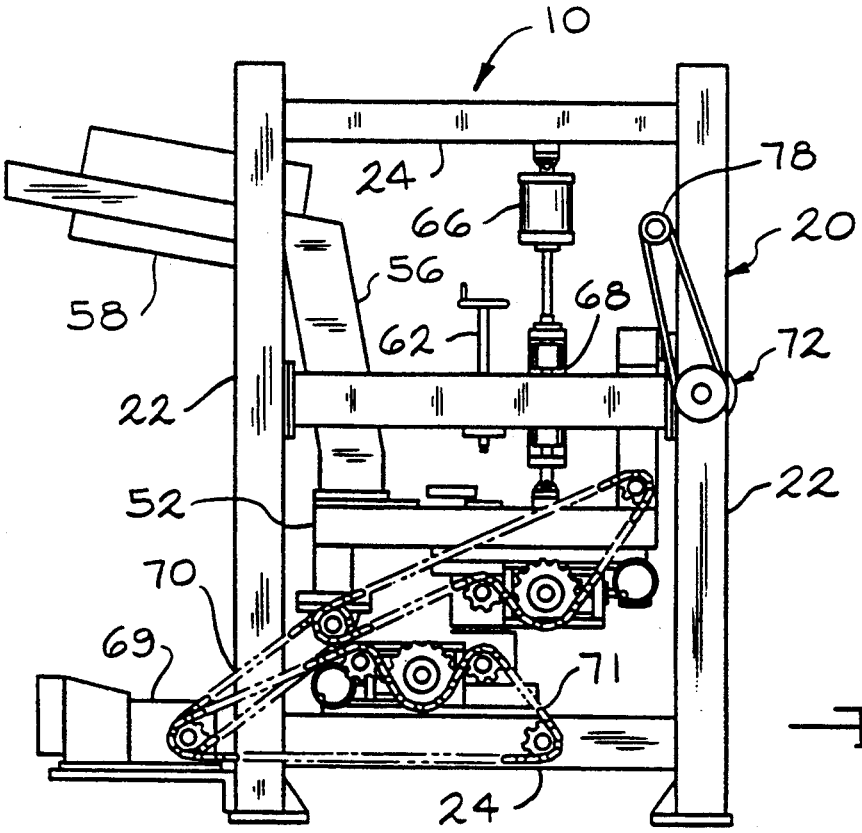
FIG. 5 is a side view of the machine of this invention showing the side opposite that shown in FIGS. 1 and 2.

Since the separations between the coating rollers 26 and 28 and the associated doctor rollers 30 and 32 are critical to proper coating operation, adjustment mechanisms are provided. Crank 38 is shown in FIGS. 1 and 3 for driving a lead screw which moves doctor roller 32 in a horizontal direction, toward and away from coating roller 28. As shown, in FIG. 2 the bearing block 39 which supports doctor roller 32 moves horizontally in a slide mechanism 40. Similarly, crank 42 provides for horizontal adjustment of the doctor roller 30 operating along slide 44. Identical crank and slide arrangements are provided at the opposite axial ends of doctor rollers 30 and 32, as shown in FIG. 5. These mechanisms allow not only the separation between the rollers to be adjusted but also enable their orientation to be set parallel to one another.

Workpieces are fed into roll coater machine 10 through inlet conveyer 14. Although various types of conveyer systems can be implemented, a preferred type for many sheet workpieces to be coated would be string-type conveyers which have a multiplicity of strings 46, each of which is driven to move the workpiece and at the same time minimize the area of contact with the workpiece. Inlet conveyer 14 moves parts into machine 10 and ends adjacent to coating rollers 26 and 28. A series of rollers 48 is provided which press the workpiece 12 against the conveyer strings to assure that the workpiece will be driven through machine 10. Exit conveyer 16 may have a construction similar to that of inlet conveyer 14. Exit conveyer 16 is positioned immediately after coating rollers 26 and 28 to receive the coated part. Exit conveyer 16, like conveyor 14, similarly incorporates a series of string elements which minimizes surface contact with the coated workpiece. Exit conveyer 16 moves the coated workpieces to subsequent work stations for further processing.

Figure 2:
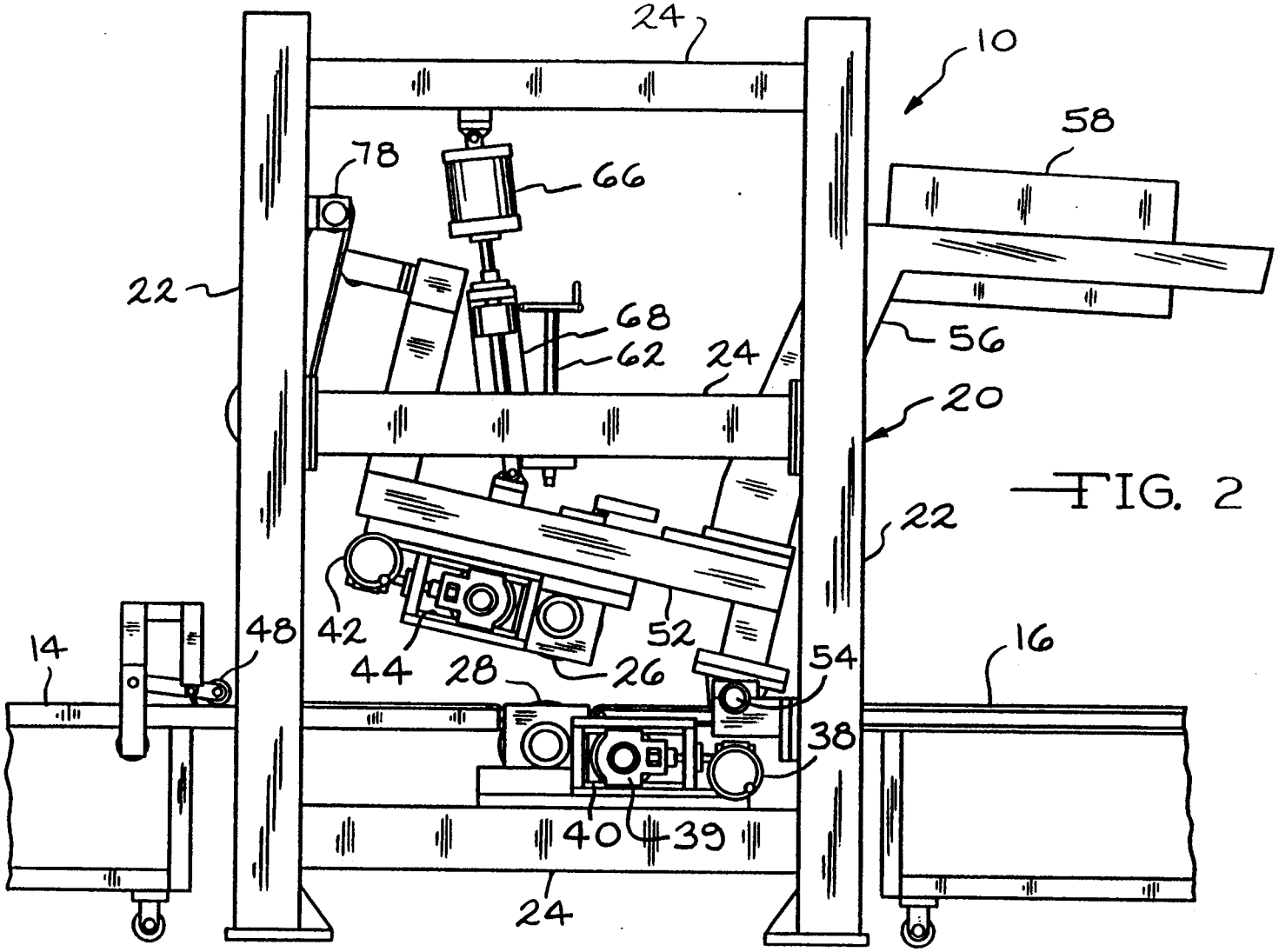
FIG. 2 is a side view like FIG. 1 except showing the upper coating roller in an elevated position.
Figure 3:
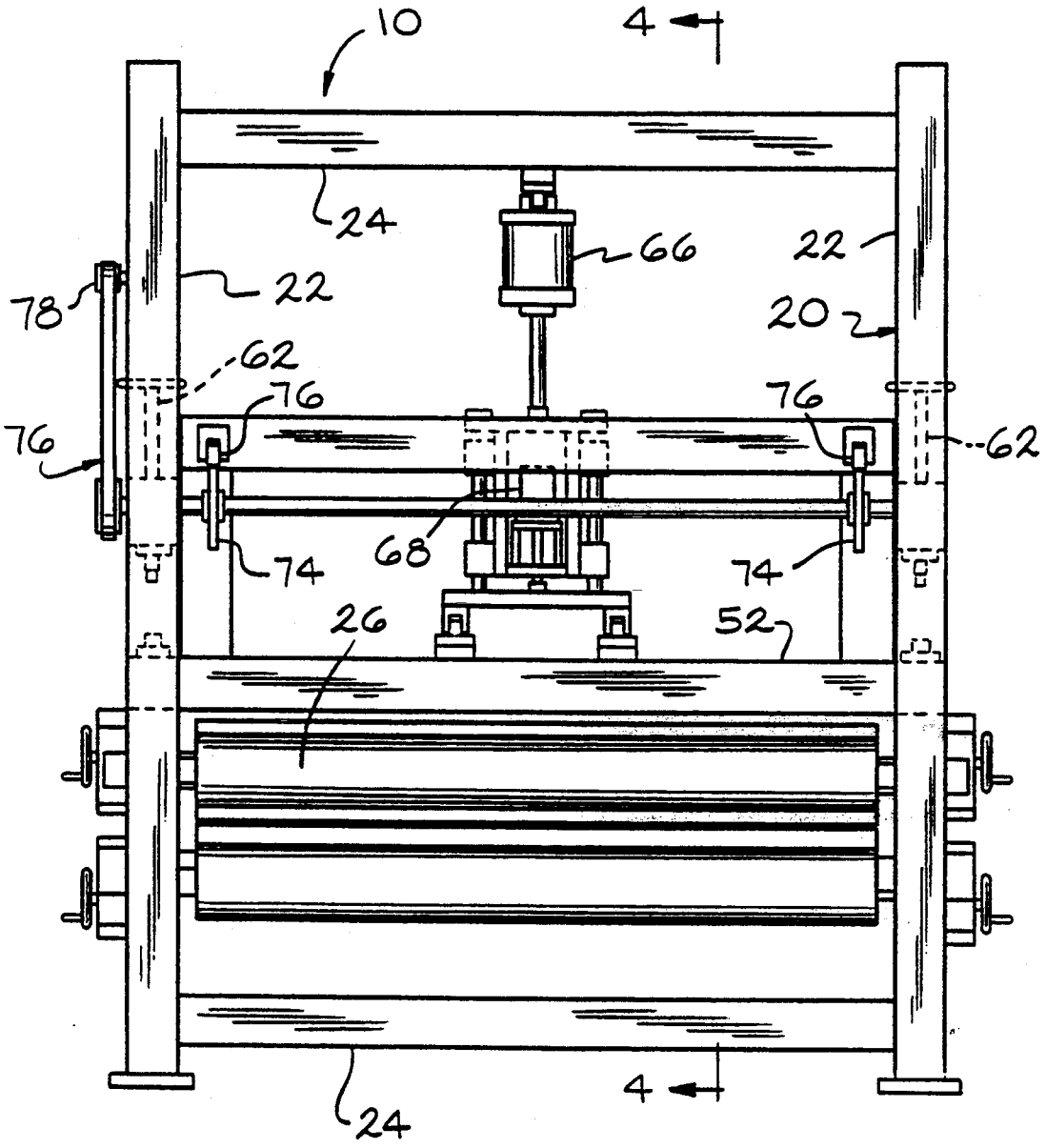
FIG. 3 is a front elevational view of the roll coater machine of this invention.
Figure 4:
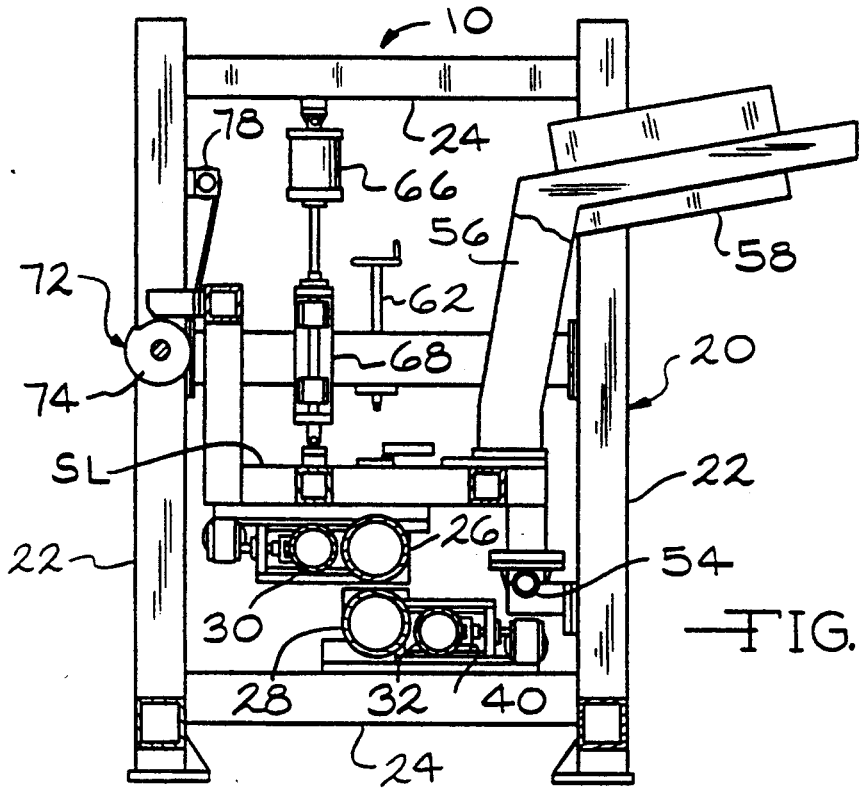
FIG. 4 is a cross-sectional view taken along line 4—4 of FIG. 3.

As best shown by FIGS. 1 and 2, roll coating machine 10 in accordance with this invention incorporates novel features for allowing the separation distance between coating rollers 26 and 28 to be automatically adjusted for different thicknesses of workpiece 12. In machine 10, lower coating roller 28 is fixed to frame 20 whereas upper coating roller 26 is mounted such that its vertical position can be changed. Upper coating roller 26 is supported by floating frame 52 which is mounted for pivoting movement relative to frame 20 at pivot bearings 54. Floating frame 52 includes extension arm 56 having counter-weight 58. Floating frame 52 is balanced such that the entire frame can be pivoted about bearings 54 with a very slight torque. The counterweighing can be adjusted such that there is a small unbalance force which causes floating frame 52 to rotate in a clockwise direction, separating the coating rollers or in the opposite direction urging the coating rollers together. To control unrestrained motion of floating frame 54, manually adjusted jack screws 62 are provided as hard stops for motion of floating frame 52. A motor 69 drives coating and doctor rollers 26 through 30 through chains 70 and 71 meshing with a series of sprockets as shown in FIG. 5.

With particular reference to FIGS. 1, 2 and 3, roll coater machine 10 incorporates a number of mechanisms which can be used together or independently to set an appropriate spacing between coating rollers 26 and 28 to accommodate a particular workpiece thickness. A pair of cylinders 66 and 68 are provided for applying a controlled force onto floating frame 52. Cylinder 66 is a conventional single or double acting air or hydraulic cylinder which produces a large displacement of floating frame 52. For example, cylinder 66 could be actuated where there is a need for the rollers 26 through 32 to be inspected for cleaning or other maintenance procedures as shown by FIG. 2. By exerting an upward force, cylinder 66 forces floating frame 52 to stop against jack screw adjustment 62. Cylinder 68 on the other hand is not provided to provide gross displacement but rather provides a highly accurately controllable downward or upward force on floating frame 52. The combined effect of counter-weighing floating frame 52 and applying a controlled air pressure signal to cylinder 68 provides an accurate downward force acting on floating frame 52. Since conventional piston cylinders exhibit a characteristic known as "stiction" where the static coefficient of friction between the piston and cylinder is greater than the dynamic coefficient, special designs for cylinder 68 are needed. One design is a so-called rolling diaphragm type having an internal folded diaphragm as opposed to a conventional piston and cylinder arrangement. By coupling such a cylinder with a accurately controlled servo-pressure regulator, a precise force can be provided which is constant either statically or dynamically.

In one approach of setting the separation between coating rollers 26 and 28, as workpieces are fed through the machine, the precisely controlled pressure exerted by cylinder 68 causes the machine to automatically respond to changes in workpiece thickness. Since the workpiece 12 is compressed as it passes between coating rollers 26 and 28, a small net downward force acting on coating roller 26 can be set to provide a desired degree of workpiece material compression, irrespective of its thickness. Before a workpiece is sent through the machine in this mode of operation the net downward force exerted by cylinder 68 causes coating rollers 26 and 28 to contact one another. As the workpiece is fed through the machine, compression of the workpiece urges the rollers apart in a controlled manner. The degree of compression of the workpiece material is adjusted by the pressure applied to cylinder 68.

Another mechanism provided by roll coater machine 10 for accommodating various workpieces incorporates thickness gauge 70 shown in FIG. 1A which provides a signal related to the material thickness. That signal is processed and a control signal is generated which actuates cam adjuster 72 which controls coating roller separation. Cam adjuster 72 incorporates a rotary cam 74 mounted to frame 20 which is contacted by roller follower 76 carried by floating frame 52. A pair of identical cam adjusters 72 are used, with one at each side of machine frame 20. A rotary actuator 78 controls the rotational position of rotary cam 74 which has an outer surface having a varying radius. Therefore the rotational indexed position of rotary cam 74 causes upward and downward motion of floating frame 52. In order to maintain contact by follower 76 with rotary cam 74, a net downward pressure is exerted by cylinder 68. In operation, the piston of cam 74 sets the separation distance and the coating rollers 26 and 28 do not move in response to the compressive force exerted on the workpiece 12.

A hybrid of the approaches described previously which incorporates the automatic adjustment function of cylinder 68 with the pre-gauging concept can also be implemented. By pre-gauging the incoming part, rotary cam 74 can be indexed to a position which provides slightly less than the appropriate coating roller separation for a particular workpiece. The precise separation is thereafter established through operation of cylinder 68 as previously described in that the rollers separate if the compression force is excessive. Such a hybrid arrangement may be desirable to control oscillations or "hunting" which could occur as the floating frame 58 responds dynamically during operation when pre-gaging is not used. Moreover, due to the significant moment of inertia of floating frame 52, pre-setting of the coating roller separation to a nominal value appropriate for a given workpiece may overcome the inevitable lag time which occurs as the coating rollers adjust to incoming workpieces.

Figure 7:
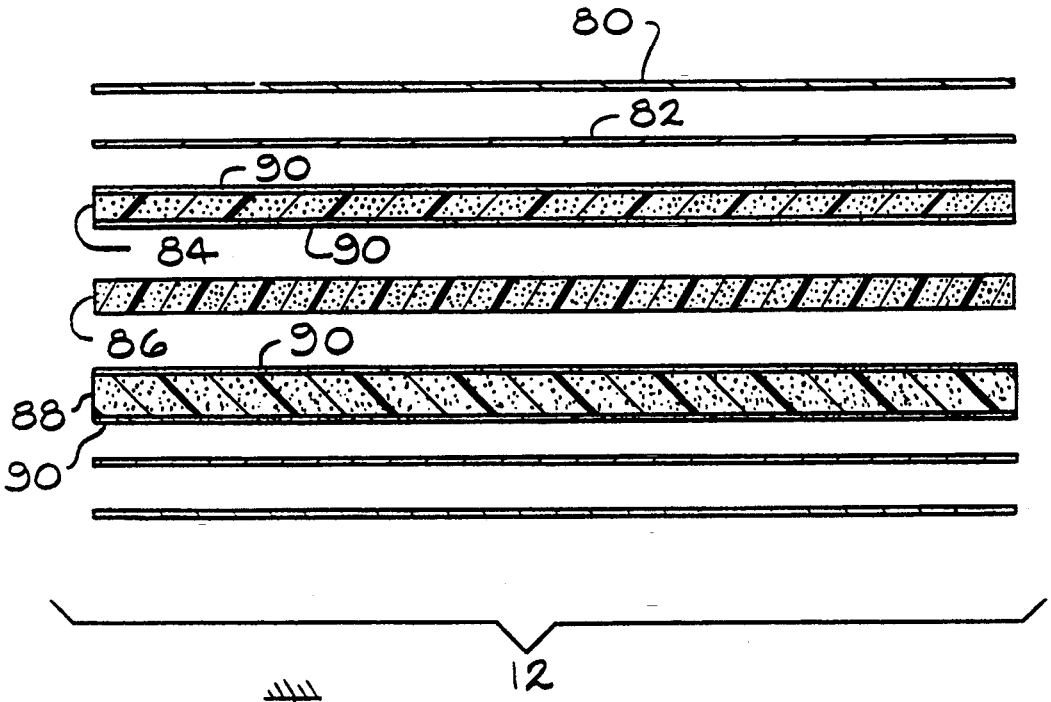
FIG. 7 is an exploded cross-sectional view of a representative part of the type which may be processed using the roll coater machine of this invention.

An example of a workpiece 12 in the form of an automotive headliner component which can be processed through use of roll coater machine 10 is shown in FIG. 7. Automotive headliner 12 is multi-layer fabricated assembly in which the top layer 80 comprises a nylon fabric cover which is the trim material seen by the motor vehicle occupant when the headliner is assembled in the vehicle. Fiberglass scrim 82 is provided for stiffening and helps prevent bleed-through of adhesives onto the nylon fabric cover 80. A series of three layers 84, 86, and 88 of soft polyurethane foam is shown which are compressed together to form a sandwich to provide a desired degree of structural rigidity of the final assembly. Layers 84 and 88 have coatings of adhesive material 90 applied on both sides thereof. These layers of adhesive material are coated using roll coater 10 according to this invention. As is shown in FIG. 7, layers 84 and 88 have differing thickness, which as stated previously can be readily accommodated by machine 10. Another fiberglass scrim 92 and non-woven felt 94 comprise the remaining layers of the headliner workpiece 12. This example of a workpiece 12 is only one of many types of composite multi-layer workpieces which can be processed using machine 10 of this invention.

While the above description constitutes the preferred embodiments of the present invention, it will be appreciated that the invention is susceptible of modification, variation and change without departing from the proper scope and fair meaning of the accompanying claims.

We claim:

1. A machine for coating liquid onto sheet material workpieces comprising;

a frame, a first coating roller fixed for rotation relative to said frame, a second coating roller fixed for rotation relative to said frame, coating means for causing said liquid to coat at least one of said first or second roller, transport means for causing said sheet material workpieces to enter said machine and pass between said first and second coating rollers thereby causing said liquid coating at least one of said coating rollers to be transferred onto said sheet material workpieces, and adjustment means for causing the separation distance between said first and second coating rollers to automatically adjust to a desired separation distance for said sheet material workpieces of varying thicknesses, said adjustment means including a movable frame member supporting at least one of said coating rollers and a gaging means for measuring the thickness of said sheet material workpieces before passing between said coating rollers and an actuator for setting a separation distance between said rollers, said actuator having a cam and follower which set a minimum distance between said coating rollers, and said adjustment means having a pressure applying member for applying a controllable force on said moveable frame member causing said follower to engage said cam and enabling said rollers to separate beyond said minimum distance causing said follower to disengage said cam in response to the compressive force exerted by said rollers against said workpieces exceeding a predetermined level.

2. A machine according to claim 1 wherein said coating means comprises a doctor roller positioned adjacent at least one of said coating rollers defining a fluid bath for retaining said liquid.

3. A machine according to claim 1 wherein said adjustment means moveable frame includes a counterweight for balancing at least a portion of the weight of said coating roller supported by said moveable frame.

4. A machine according to claim 1 wherein said adjustment means pressure applying member comprises a pneumatic rolling diaphragm cylinder.

5. A machine according to claim 1 wherein said liquid coats both said first and second coating rollers to apply said liquid at an equivalent rate on both opposite surfaces of said sheet material workpieces.

6. A machine according to claim 1 wherein said liquid coats both said first and second coating rollers to apply said liquid at unequal rates on both opposite surfaces of said sheet material workpieces.

* * * * *

UNITED STATES PATENT AND TRADEMARK OFFICE

CERTIFICATE OF CORRECTION

PATENT NO. : 5,385,610

DATED : January 31, 1995

INVENTOR(S) : Richard P. Doerer, Kenneth G. Huber

It is certified that error appears in the above-indentified patent and that said Letters Patent is hereby corrected as shown below:

On title page: item [19] and [54]
Under inventors, delete "Deerer" and insert —Doerer—.

Signed and Sealed this

Ninth Day of May, 1995

Bruce Lehman

*Attest:*

BRUCE LEHMAN

*Attesting Officer*

*Commissioner of Patents and Trademarks*